United States Patent [19]

Zimmer

[11] 3,942,439

[45] *Mar. 9, 1976

[54] DYESTUFF APPLICATOR FOR SCREEN PRINTER

[76] Inventor: Peter Zimmer, Untere Sparchen 54, A 6330 Kufstein, Austria

[ * ] Notice: The portion of the term of this patent subsequent to Nov. 25, 1992, has been disclaimed.

[22] Filed: Jan. 3, 1974

[21] Appl. No.: 430,389

[30] Foreign Application Priority Data

Feb. 5, 1973 Austria ..... 115/73

[52] U.S. Cl. ..... 101/120; 118/406

[51] Int. Cl.[2] ..... B41F 15/40

[58] Field of Search ..... 101/114, 115, 119, 120, 101/121–124, 129; 118/406

[56] References Cited

UNITED STATES PATENTS

| | | | |
|---|---|---|---|
| 846,645 | 3/1907 | Brooks | 101/119 X |
| 1,541,787 | 6/1925 | Cadgene | 101/116 X |
| 2,445,666 | 7/1948 | Ellam | 101/119 |
| 3,592,132 | 7/1971 | Weber | 101/119 |
| 3,752,071 | 8/1973 | McKay | 101/125 |
| 3,799,053 | 3/1974 | Rabelow | 101/125 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A downwardly open applicator housing, surrounding and mounted on a dyestuff-supplying tube within a cylindrical printing screen, carries an elastic diaphragm which spans its lower end in a slack state so as to hang down with a convex underside under the weight of a load of dyestuff in the housing and a pair of bars bearing upon the diaphragm from above. The central region of the diaphragm, flanked by the weighting bars, has a series of axially spaced openings for the discharge of the dyestuff; a flexible but substantially inextensible reinforcing strip of low-friction material, having a longitudinal slot registering with these openings, is bonded to the underside of the diaphragm to facilitate relative sliding of the screen and seal the gap region against leakage of dyestuff onto the inner screen surface. The upper diaphragm surface may have gap-bridging elements such as threads or wires bonded thereto as additional reinforcements.

12 Claims, 4 Drawing Figures

DYESTUFF APPLICATOR FOR SCREEN PRINTER

CROSS-REFERENCE TO RELATED APPLICATIONS

This application relates to subject matter disclosed in my copending applications Ser. Nos. 320,739 filed 3 Jan. 1973, Ser. No. 364,560 filed 29 May 1973, and Ser. No. 376,714 filed 5 July 1973.

FIELD OF THE INVENTION

My present invention relates to a dyestuff applicator for a printing machine of the type wherein a perforated cylindrical screen is rotatable about a horizontal axis and surrounds a housing forming an axially extending gap just above the nadir of the screen for the controlled discharge of printing liquid (referred to hereinafter as ink) through the perforations of the screen onto a substrate for imprinting the latter in accordance with a predetermined pattern.

BACKGROUND OF THE INVENTION

In my above-identified copending applications I have disclosed various structures defining the discharge gap at the bottom of the applicator housing. According to application Ser. No. 320,739. the gap is formed between two sealing strips weighted down by two parallel rods attracted downwardly by a magnetic force. Application Ser. No. 364,560 discloses an applicator housing with a downwardly convex bottom member of elastic material having an axially extending slot, this slot being spanned by transverse pins, wires or other substantially inextensible reinforcing means secured to the housing bottom and leaving clearances for the passage of the printing liquid. In application Ser. No. 376,714 I have divulged an arrangement wherein the bottom of the downwardly open applicator housing is spanned by two perforated layers separately fastened to the housing wall, specifically a rubber diaphragm and a metal foil.

OBJECT OF THE INVENTION

The object of my present invention is to provide a simplified construction of the type disclosed in my prior applications which not only maintains a constant gap width but also effectively prevents the leakage of ink from the region of the gap onto the inner screen surface whence the liquid might pass outwardly through the perforations of the screen to smudge the substrate.

SUMMARY OF THE INVENTION

I realize this object, in conformity with my present invention, by the provision of a preferably elastic diaphragm which extends across the open bottom of the applicator housing, hanging down under the weight of an overlying body of dyestuff in the housing so as to approach the nadir of the surrounding printing screen, a central region of that diaphragm being provided with one or more rows of axially spaced outlet openings; a flexible but substantially inextensible reinforcing strip is secured to the underside of the diaphragm in that central region, the strip having a median slot which registers with the outlet opening to form the discharge gap.

The strip advantageously consists of a low-friction material, such as a mixture of Teflon with a filler, in order to facilitate the relative sliding motion of the rotating screen contacted by the strip.

Especially if the strip is adhesively bonded to the diaphragm, the bridges formed between the axially spaced outlet openings of the latter prevent any substantial widening of the slot present in this strip, and therefore of the discharge gap. Further stabilization of the gap width may be achieved by the provision of supplemental reinforcing means, such as wires or other elongate elements, secured to the upper diaphragm surface and extending across the perforated region thereof.

BRIEF DESCRIPTION OF THE DRAWING

The above and other features of my invention will mow be described in detail with reference to the accompanying drawing in which.

SPECIFIC DESCRIPTION

Figure 1:
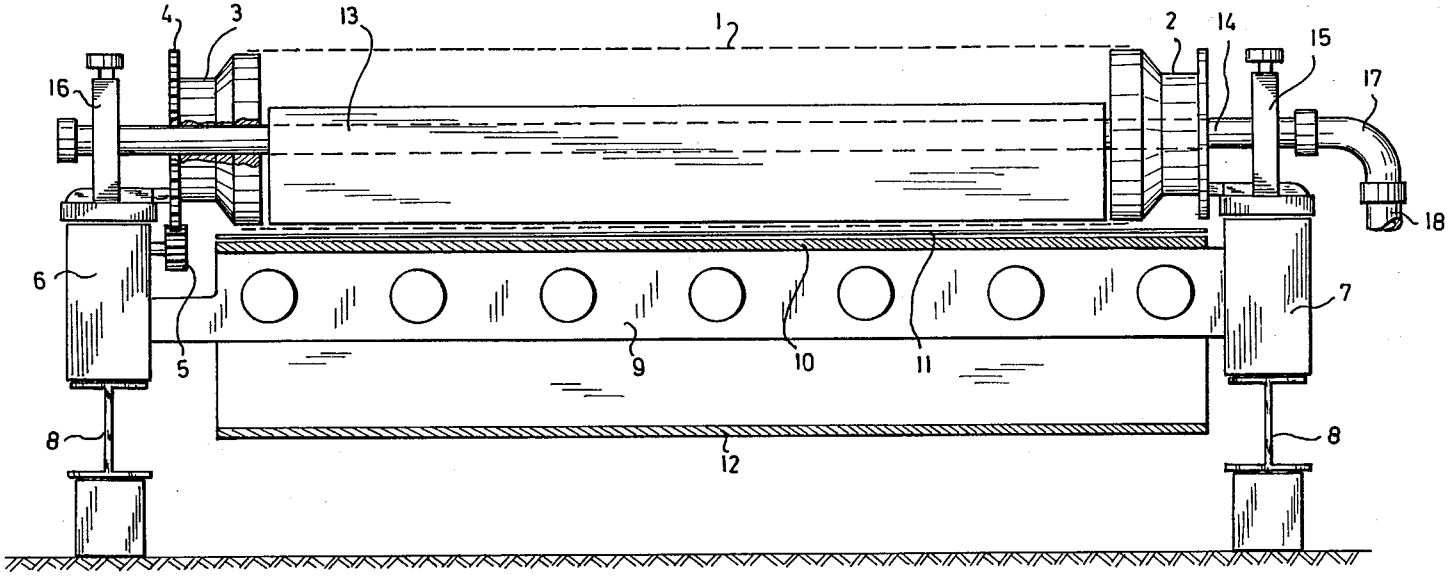
FIG. 1 is a cross-section through a screen printing machine which is provided with a dyestuff applicator embodying my invention.

As shown in FIG. 1, a cylindrical silk screen 1 is clamped in a fixed axial position by means of two end pieces 2 and 3 but mounted for rotation about its axis on a printing machine. The left end piece 3 carries a drive wheel 4 which meshes with a pinion 5 driven by the machine via a transmission located in a gear box 6; the gear box 6 and a dummy box 7 form part of the machine frame which also includes beams 8 as well as a printing table 9. The unit just described is duplicated a number of times in the longitudinal direction of the machine, i.e. in a direction normal to the plane of FIG. 1. The upper run 10 of an endless web mounted on the printing table 9, whose lower run is indicated at 12, supports during the printing operation a substrate 11, glued thereto, for unidirectional motion under the printing screen 1. Within the printing screen 1 there is disposed an applicator 13 which is carried by an ink tube 14 mounted in two adjustable holders 15 and 16. These holders 15 and 16 permit a change in the vertical position of the applicator 13 as well as a swinging of that applicator about the tube axis.

The tube 14 receives dyestuff from an ink pump (not shown) via an elbow 17 and a conduit 18.

Figure 2:
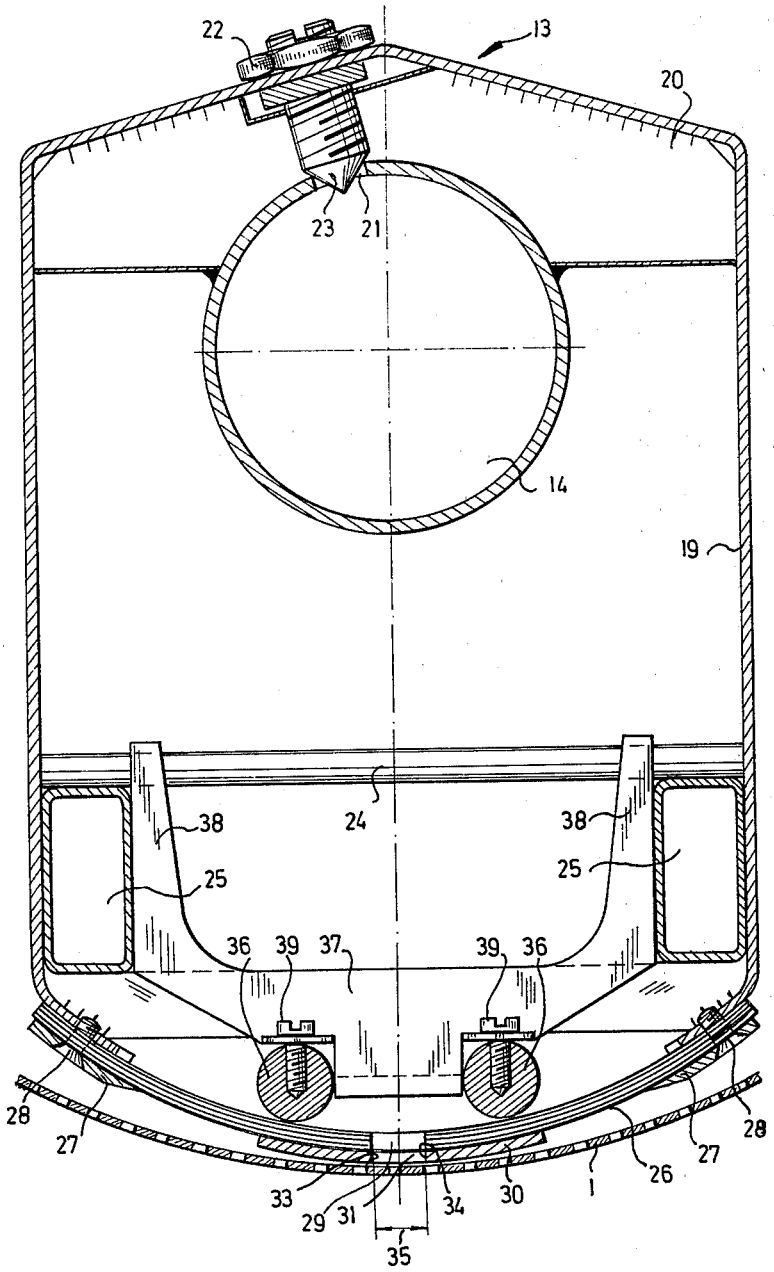
FIGS. 2 and 3 are transverse and partial longitudinal cross-sections, respectively, of the application shown in FIG. 1.
Figure 3:
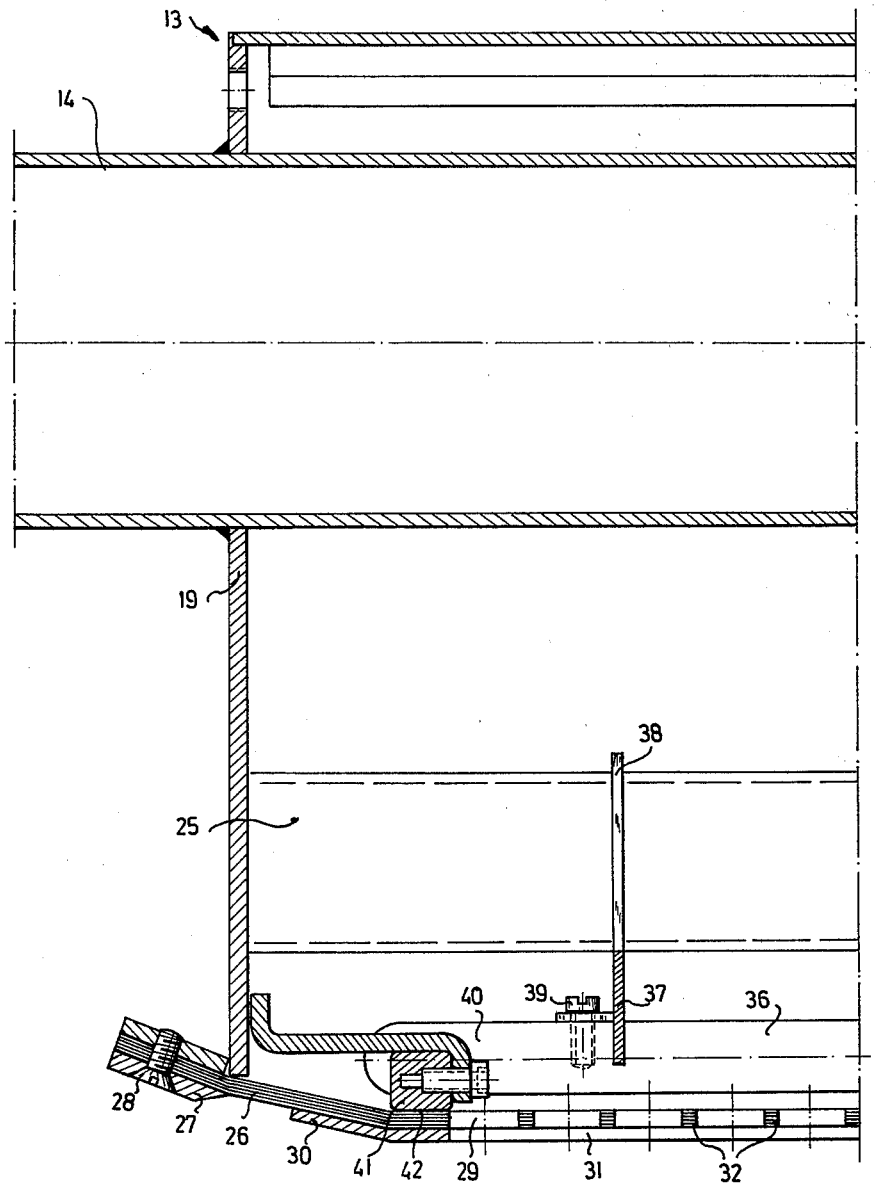

As more particularly illustrated in FIGS. 2 and 3, applicator 13 comprises a housing 19 surrounding the ink tube 14, housing 19 being reinforced by an internal rib 20 in its upper region. The ink can emerge from tube 14 via bore holes 21 (only one shown). In order to permit adjustment of the pressure of the ink in the housing 19, as it issues from tube 14, I provide each hole 21 with a throttle screw 22 whose tapered end 23 enlarges or reduces the effective width of that hole, depending upon the position of the screw 22. The housing 19 is completely filled with ink during operation. In order to resist the hydrostatic pressure of the liquid dyestuff acting upon the walls of the housing 19, these walls are interconnected by tie rods 24 and bear upon square pipes 25 which in turn are held apart by spacers 37 more fully described hereinafter. This construction also stiffens the housing 19 against flexural stresses. The lower region of the housing is closed by an elastic diaphragm 26 consisting, for example, of rubber. The diaphragm 26 is fastened at its edges by clamping strips 27 and screws 28 to the housing 19 and is provided at its lowest point with outlet openings 29 for the distribution of the ink onto the substrate 11 through the perforations of screen 1. The diaphragm 26 has a substantially inextensible low-friction cover strip 30 secured to its underside which on the one hand assures easy sliding of the screen 1 across the region provided with discharge openings 29 and on the other hand reinforces the elastic diaphragm in that central region.

The cover strip 30 has a median slot 31, serving as a discharge gap, in the region of the openings 29, immediately above the nadir of screen 1; this slot is continuous in the longitudinal direction, in contradistinction to the outlet openings 29 of the slack, flexible diaphragm 26 which are separated by bridges 32 (FIG. 3) spanning the longitudinal slot edges 33 and 34. Thus, the applicator 13 can rest on the screen 1 with maintenance of a constant gap width 35, in order to seal the assembly against leakage of dyestuff onto the inner screen surface from the gap, the seal being effective even with applicators of considerable axial length and substrate widths between about 2 and 5 meters for which the prevention of leakage has heretofore been realizable only with very great difficulties. The strip 30 preferably consists of a mixture of Teflon and an organic or inorganic filler, e.g. powdered glass; a metal foil or some other material could also be used. Strip 30 is preferably connected with diaphragm 26 by adhesive bonding. The stabilization of the gap width by bridges 32 assures that the width 35 of the slot 31 always remains constant. This slot also constitutes a flow channel enabling pressure equalization in the body of ink passing from the discharge openings 29 through the perforations of the screen 1 to the underlying substrate 11.

The close contact between the strip 30 and the screen 1 is insured by weighting means in the form of round bars 36, preferably of metal, flanking the openings 29 and the slot 31. The bars 36 bear upon the layers 26, 30 either solely under their own weight or with the assistance of magnetic forces, as disclosed in my prior applications identified above. Furthermore, spring elements preferably bearing upon the tie rods 24 could press the bars 26 against the screen 1. The bars 36 are held fast in their relative position by spacers 37 which are plates with upstanding lugs 38 slidably resting against the rectangularly profiled pipes 26 so as to be vertically displaceable therebetween. The connecting plates 37, acting as bracing means are fastened to the bars 36 by screws 39.

The ends 40 of the bars 36 are interconnected by respective pressure members 41, one of them being shown in FIG. 3. This member also assures close contact between the diaphragm 26 and the strip 30 with the screen 1 at that point. Member 41 conforms at its lower surface 42 approximately to the curvature of the printing screen 1. Small deviations in the radii of curvature are taken up by the elasticity of the diaphragm 26 and the flexibility of strip 30.

Figure 4:
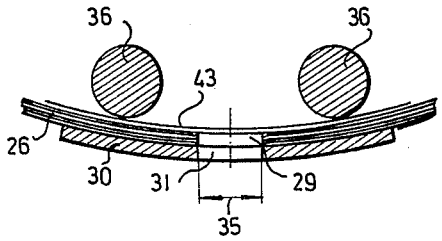
FIG. 4 is a cross-sectional detail view showing a partial modification.

As shown in FIG. 4, the constancy of the width 35 of the gap 31 is additionally insured by supplemental reinforcing means in the shape of a set of elongate elements, specifically thin wires 43 of a corrosion-resistant material such as stainless steel, the wires being bonded onto the upper surface of the flexible diaphragm 26, opposite strip 30. It will be noted that the rods 36 in this case rest on the reinforcing elements 43. Instead of thin wires I may also use suitable synthetic fabrics, threads or the like.

The openings 29 in the region of gap 31 could have various geometrical shape and may also be arranged in several rows, possibly staggered, so that a uniform flow of dyestuff is assured.

I claim:

1. A dyestuff applicator for a printing machine provided with a perforated cylindrical screen centered on a horizontal axis for rotation therearound, comprising:
   - a downwardly open housing surrounded by said screen;
   - a dyestuff-supplying tube opening into the interior of said housing;
   - a flexible diaphragm extending across the bottom of said housing and hanging down under the weight of an overlying body of dyestuff in said housing toward the nadir of said screen, said diaphragm being provided in a central region overlying said nadir with at least one row of axially spaced outlet openings; and
   - a flexible but substantially inextensible reinforcing strip secured to the underside of said diaphragm in said central region, said strip being provided with a median slot registering with said openings and forming a discharge gap for said dyestuff immediately above the nadir of said screen, said diaphragm keeping the width of said slot substantially constant.

2. A dyestuff applicator as defined in claim 1 wherein said strip is secured to said diaphragm by adhesive bonding.

3. A dyestuff applicator as defined in claim 1 wherein said diaphragm is elastic.

4. A dyestuff applicator as defined in claim 1 wherein said strip includes a low-friction material.

5. A dyestuff applicator as defined in claim 4 wherein said low-friction material comprises a mixture of Teflon with a filler.

6. A dyestuff applicator as defined in claim 1, further comprising weighting means bearing from above upon said diaphragm on opposite sides of said slot.

7. A dyestuff applicator as defined in claim 6 wherein said housing is provided with internal bracing means above said diaphragm, said weighting means being a pair of bars secured to said bracing means.

8. A dyestuff applicator as defined in claim 1 wherein said housing is mounted on said tube.

9. A dyestuff applicator as defined in claim 8 wherein said tube is centered on said axis.

10. A dyestuff applicator as defined in claim 1, further comprising supplemental reinforcing means secured to the upper surface of said diaphragm and extending across said central region.

11. A dyestuff applicator as defined in claim 10 wherein said reinforcing means comprises a set of elongate elements.

12. A dyestuff applicator as defined in claim 10 wherein said reinforcing means is bonded to said upper surface.

* * * * *